US006722422B1

(12) United States Patent
Feldmeier

(10) Patent No.: US 6,722,422 B1
(45) Date of Patent: Apr. 20, 2004

(54) HEAT EXCHANGE SYSTEM WITH IMPROVED FLOW VELOCITY ADJUSTMENT MECHANISM

(75) Inventor: Robert H. Feldmeier, Fayetteville, NY (US)

(73) Assignee: Feldmeier Equipment, Inc., Syracuse, NY (US)

( * ) Notice: Subject to any disclaimer, the term of this patent is extended or adjusted under 35 U.S.C. 154(b) by 0 days.

(21) Appl. No.: 10/458,012

(22) Filed: Jun. 10, 2003

(51) Int. Cl.[7] ..... F28D 7/10; F28D 1/00; F15D 1/00

(52) U.S. Cl. ..... 165/154; 165/150; 165/141; 138/39; 138/114

(58) Field of Search ..... 165/150, 154, 165/141, 156, 178; 29/890.036, 890.043; 138/39, 40, 95, 114; 285/332, 332.1

(56) References Cited

U.S. PATENT DOCUMENTS 3,347,728 A * 10/1967 Preotle et al. ..... 156/283
3,581,475 A * 6/1971 Sauder ..... 96/407
3,650,322 A * 3/1972 De Munnik ..... 165/143
4,258,460 A * 3/1981 Melnyk ..... 29/890.043
4,357,990 A * 11/1982 Melnyk ..... 165/76
5,174,369 A * 12/1992 Glass ..... 165/155
5,211,221 A * 5/1993 Lease ..... 165/150
5,380,048 A * 1/1995 Vogel ..... 285/22

* cited by examiner

*Primary Examiner*—Henry Bennett
*Assistant Examiner*—Tho Duong
(74) *Attorney, Agent, or Firm*—Christopher R. Pastel; Hancock & Estabrook, LLP

(57) ABSTRACT

A heat exchange system utilizing flow reducers at 180 degree bends in the tubes includes a first set of media tubes in which heating/cooling media flows, and a set of product tubes positioned concentrically within the media tubes and in which liquid product flows in a counter direction to the heating/cooling media. The tubes are arranged in a serpentine, back and forth manner, and U-shaped tubes interconnect successive pairs of product tubes to achieve the 180-degree change in flow direction. The U-shaped tubes are of a cross-sectional diameter greater than the product pipes. Tapering flow reducers extend between the opposing ends of the U-shaped tubes and the product tubes. The exit flow reducer is eccentrically formed to facilitate a smooth transition of the product from the U-shaped bend to the product tube and prevent liquid product from becoming entrapped along the bottom of the flow reducer.

8 Claims, 3 Drawing Sheets

HEAT EXCHANGE SYSTEM WITH IMPROVED FLOW VELOCITY ADJUSTMENT MECHANISM

BACKGROUND OF THE INVENTION

1. Field of Invention

The present invention relates generally to heat exchange systems, and more particularly to heat exchange systems that use at least two tubes, one concentrically positioned within the other and arranged in a serpentine manner.

2. Description of Prior Art

Heat exchange systems are sometimes used in the liquid food processing industry for destroying bacteria that may be present in the food product. Examples of what are generically referred to as "liquid food product" that is subjected to a heat exchange system for destroying harmful bacteria include milk, liquid egg product, juices, slurries, slurries in suspension, pharmaceuticals, and other beverages. In use, the food product flows through an inner tube in a first direction, while the heating/cooling media flows through the outer tube in the opposite direction. Such a system is generally referred to as a tube-in-tube arrangement, or a two-tube arrangement, but the same concept has been applied to three tube arrangements, wherein heating/cooling media flows in an inner-most tube and the outer-most tube in one direction, while food product flows through the central tube in the opposite direction.

It is useful for these types of heat exchange systems to be arranged in a serpentine (or back and forth) manner to conserve space, and with a slight downward pitch to facilitate fluid drainage when necessary. To achieve this arrangement, a U-shaped tube generally interconnects two product tubes extending in spaced parallel relation to one another. The heating/cooling media tubes are also interconnected to one another through connecting tubes, but not necessarily U-shaped tubes. In order to clean these systems without having to dismantle the tubes, the tubes are generally sloped downwardly in order to permit gravity to assist in draining them.

For obvious reasons, it is necessary to clean and decontaminate the tubes on a regular basis. To clean the tubes, they must first be drained and then flushed with a cleaning solution. Connecting a pump to a terminal tube to force the food product through the tubes, and then pumping cleaning fluid through the system generally accomplish this cleaning process. To prevent the fluid from backing up in the tubes due to pressure differentials created at the bends, the U-shaped tubes are generally of a greater cross-sectional diameter than are the product tubes. Tapering flow reducers are used to interconnect the U-shaped tubes to the product tubes. The prior art flow reducers used at the junctions of the U-shaped connecting tubes and the food product tubes generally uniformly taper from the diameter of the U-shaped tube to the diameter of the food product tubes. In other words, the flow reducers are concentric in cross-section.

The concentric flow reducers improve over those systems not utilizing flow reducers at the bends (i.e., where the U-shaped tubes are of the same cross-sectional diameter as the product tubes). However, in systems employing concentric flow reducers, liquid product tends to gather and become entrapped along the bottom of the reducer that effects the ultimate change in direction of the flow. Such entrapped product may result in admixture with the cleaning fluid when it passes through the tubes, thereby resulting in contamination of the cleaning fluid and dilution of that portion of the product. Thus, a need exists for an improved flow reducer that prevents liquid product from becoming entrapped in the flow reducers.

3. Objects and Advantages

It is therefore a principal object and advantage of the present invention to provide a flow reducer for use in a heat exchange system that is effective at preventing liquid product from becoming entrapped in the flow reducers.

It is another object and advantage of the present invention to provide a flow reducer in a heat exchange system that may be efficiently interconnected or disconnected from the system.

Other objects and advantages of the present invention will in part be obvious, and in part appear hereinafter.

SUMMARY OF THE INVENTION

In accordance with the foregoing objects and advantages, the present invention provides a U-shaped connecting tube utilizing flow reducers for use in heat exchange systems of the type having a plurality of product tubes of a first cross-sectional diameter and in which liquid product flows and at least one media tube of a second cross-sectional diameter different from the first cross-sectional diameter, concentrically positioned around the product tube and in which heating or cooling media flows. The U-shaped tube generally includes a U-shaped portion of substantially constant third cross-sectional diameter greater than the first cross-sectional diameter; a first flow reducer extending from the U-shaped body portion to a first of the product tubes, and tapering from the third cross-sectional diameter to the first cross-sectional diameter; a second flow reducer of eccentric (i.e., non-uniform taper) cross-section, extending from the U-shaped body portion to a second of the product tubes, and tapering from the third cross-sectional diameter to the first cross-sectional diameter. The eccentric cross-sectional shape of at least one of the two flow reducers prevents product from gathering and becoming entrapped at the bottom of the reducer.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
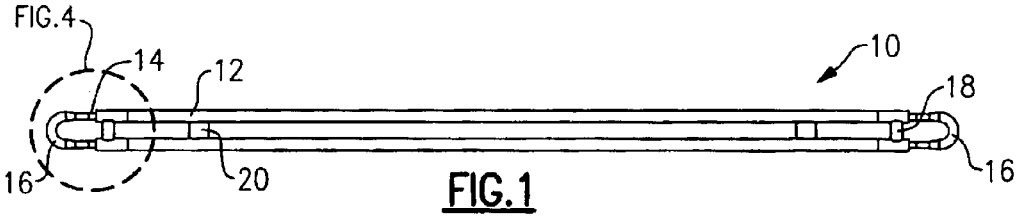
FIG. 1 is a perspective view of a heat exchange system utilizing the flow reducers of the present invention.
Figure 2:
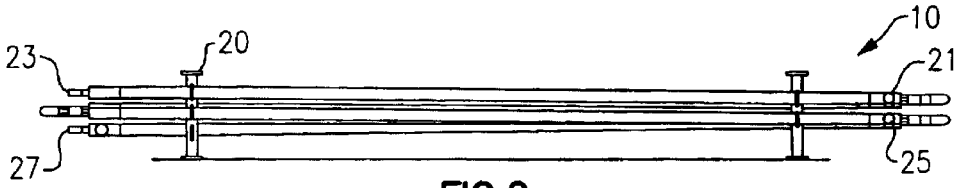
FIG. 2 is a side elevation view thereof.
Figure 3:
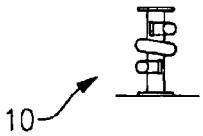
FIG. 3 is a front elevation view thereof.

Referring now to the drawings, in which like reference numerals refer to like parts throughout, there is seen in FIGS. 1–3 a heat exchange system designated generally by reference numeral 10. Heat exchange system 10 generally comprises a plurality of outer ("media") tubes 12 having a cross-sectional diameter D1 that carry heating/cooling media therein, a plurality of inner ("product") tubes 14 having a cross-sectional diameter D2 less than D1, concentrically positioned within outer tubes 12 and in which liquid product is carried, a plurality of U-shaped tubes 16 of cross-sectional diameter D3, greater than diameter D2, that interconnect pairs of product tubes 14 and change the flow direction by 180 degrees, and tubes 18 that interconnect lengths of media tubes 12 and change the flow direction by 180 degrees. Heat exchange system 10 operates by passing the media through media tubes 12 in one direction while passing product through product tubes 14 in the opposite direction, thereby creating a counter-flow that efficiently effects the heat transfer operation. The present invention could be embodied in a conventional three-tube heat exchange system that includes two media tubes (the inner-most and outer-most tubes) and one product tube concentrically disposed between the two media tubes. Feldmeier Equipment Inc. of Syracuse, N.Y. manufactures two-tube and three-tube heat exchange systems of the type disclosed herein.

Tubes 12 and 14 are generally mounted in stanchions 20 that permit assembly of the tubes with a slight downward pitch to facilitate drainage of the system, although other mounting arrangements, such as ceiling mounts, wall mounts, and bulk head mounts, could be employed. Media and product can be introduced through inlets 21, 23, respectively, and drained through outlets 25, 27, respectively, associated with media tubes 12 and product tubes 14, respectively. The downward slope of the tubes facilitates heat exchange system 10 being "cleaned-in-place" ("CIP"). In a CIP system, the product is drained from product tubes 14, and the downward slope obviously facilitates this drainage, and cleaning fluid is flushed through the tubes.

As previously stated, media tubes 12 include connecting portions 20 that extend between two lengths of tube, while pairs of product tubes 14 are interconnected by the U-shaped tubes 16. A flow velocity adjustment system is used to promote the product flow as it turns 180 degrees. To initially decrease the flow velocity of the product as it changes direction, U-shaped tubes 16 are of a greater cross-sectional diameter (D3) than are product tubes 14 (D2) and include flow reducers 24 and 26 that extend from either end of the U-tube and connect to respective product tubes 14. Due to the different diameters of U-shaped tubes 16 and product tubes 14, flow reducers 24, 26 each taper from diameter D3 of U-shaped tube 16 to the diameter D2 of product tubes 14. The flow reducer 24 of the present invention is eccentric, tapering non-uniformly, while flow reducer 26 is of conventional concentric shape, tapering uniformly between the tubes.

Figure 4:
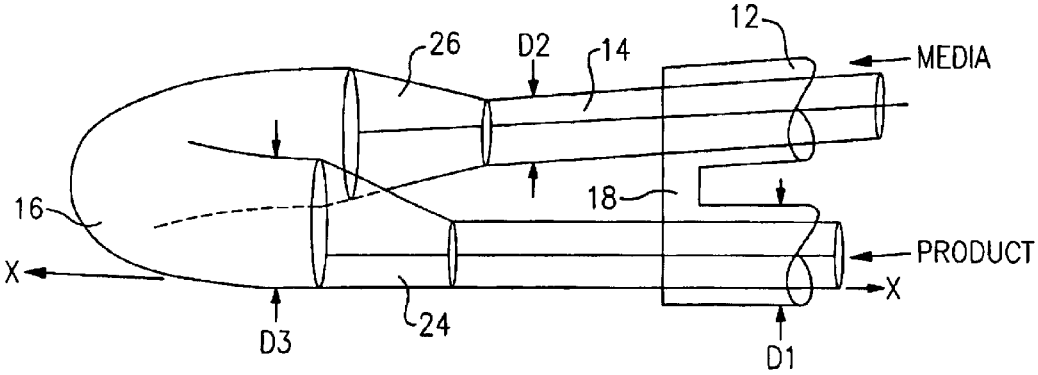
FIG. 4 is an enlarged perspective view of a U-shaped tube with flow reducers used in conjunction with a heat exchange system.
Figure 6:
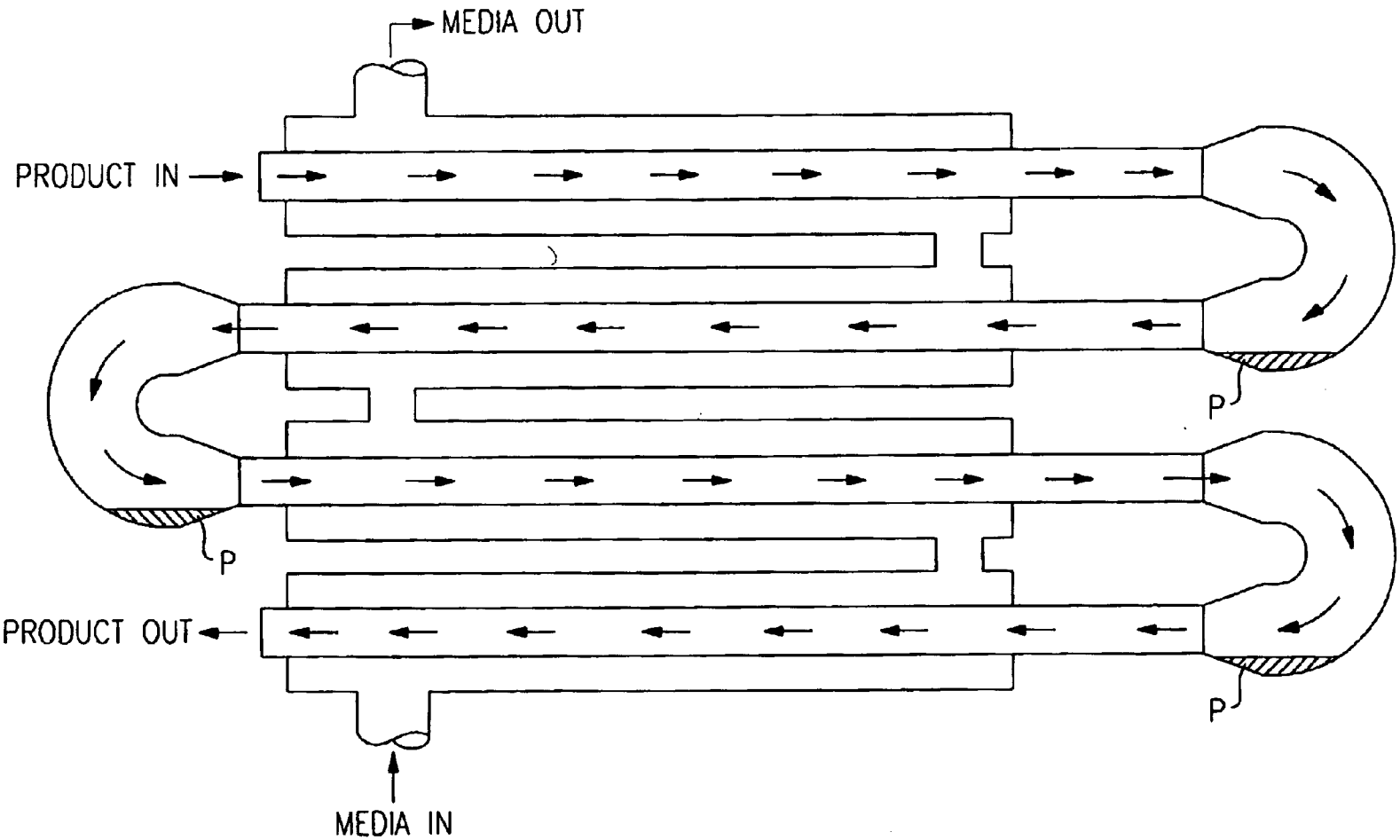
FIG.6 Prior Art
FIG. 6 is a side elevational view of a prior art heat exchanger system using concentric flow reducers.

Flow reducer 24 slows the velocity of product flowing through tubes 14 due to its diverging character (i.e., the fluid enters the smaller diameter end and exits at the larger diameter end), while flow reducer 26 accelerates the fluid flow due to its converging character (i.e., the fluid enters at the larger diameter end, and exits at the smaller diameter end). Due to the change in direction of the product effected by U-shaped tube 16 and flow reducer 26, if it was concentric (i.e., uniformly tapering) in shape as illustrated in FIG. 6, it is likely that product would become trapped along the bottom surface with the current of product passing over the top of the entrapped product maintaining it in a trapped condition. The entrapped product would then remain therein when tubes 14 are drained for cleaning, and when the cleaning fluid is introduced, it may mix with the product, thus diluting and wasting that product and contaminating the cleaning fluid. However, by making flow reducer 24 eccentric, with its floor essentially extending co-linearly with the floor of U-shaped tube 16 along axis X—X (see FIG. 4), product is less likely to become entrapped along the bottom of reducer 24.

Figure 5:
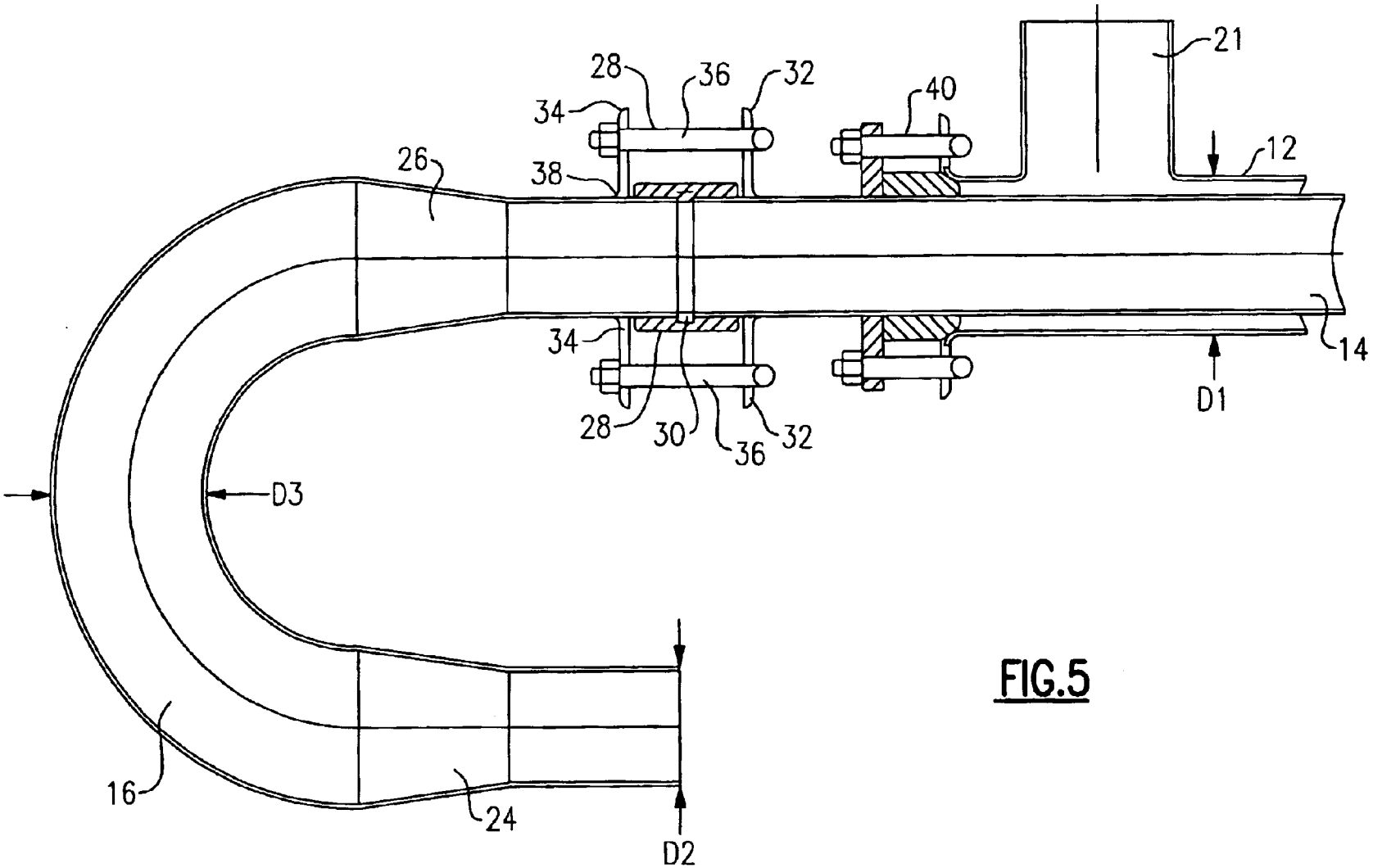
FIG. 5 is a top plan view of the U-shaped tube with flow reducers illustrated in FIG. 4.

To interconnect U-shaped tubes 16 to product tubes 14, a clamp 28, or other conventional fastener arrangement, is secured as shown in FIG. 5. Preferably, clamp 28 includes a seal (preferably composed of TEFLON®), a seal retainer 30, a pair of opposed flanges 32, 34, that engage flow reducers 24, 26 and product tubes 14, a bolt 36 for tightening flanges 32, 34, and a sealing ring 38 positioned at the interface of flanges 32, 34 and the tubes. The various sealing arrangements are preferable as they prevent fluid from seeping out of the tubes at the junctions, and the use of a bolt to tighten the clamp is preferable as it permits a quick assembly/disassembly of heat exchange system 10. A similar clamp arrangement 40 is used to connect media tubes 12 to connecting tubes 18.

What is claimed is:

1. In a heat exchanger of the type having a plurality of first tubes of a first cross-sectional diameter and in which liquid product media flows and at least one second tube of a second cross-sectional diameter different from said first cross-sectional diameter, concentrically positioned around said first tube and in which heating or cooling media flows, an improved flow velocity adjustment system for interconnecting two of said first tubes comprising:

a. a U-shaped portion of substantially constant third cross-sectional diameter greater than said first cross-sectional diameter and having first and second ends;

b. a first flow reducer extending from said first end of said U-shaped body portion to a first of said first tubes, and tapering from said third cross-sectional diameter to said first cross-sectional diameter;

c. a second flow reducer of eccentric cross-section, extending from said second end of said U-shaped body portion to a second of said first tubes, and tapering from said third cross-sectional diameter to said first cross-sectional diameter.

2. The improved flow velocity adjustment system of claim 1, wherein a portion of said second flow reducer extends co-linearly with a portion of said second of said first tubes.

3. In a heat exchanger of the type having a plurality of first tubes of a first cross-sectional diameter and in which liquid product media flows and at least one second tube of a second cross-sectional diameter different from said first cross-sectional diameter, concentrically positioned around said first tube and in which heating or cooling media flows, an improved flow velocity adjustment system for interconnecting two of said first tubes comprising:

a. a U-shaped portion of substantially constant third cross-sectional diameter greater than said first cross-sectional diameter and having first and second ends;

b. a first flow reducer extending from said first end of said U-shaped body portion to a first of said first tubes, and tapering from said third cross-sectional diameter to said first cross-sectional diameter;

c. a second flow reducer extending from said second end of said U-shaped body portion to a second of said first tubes, and non-uniformly tapering from said third cross-sectional diameter to said first cross-sectional diameter.

4. The improved flow velocity adjustment system of claim 3, wherein a portion of said second flow reducer extends co-linearly with a portion of said second of said first tubes.

5. A heat exchange system, comprising:

a. a plurality of first tubes of a first cross-sectional diameter and in which liquid product media flows;

b. at least one second tube of a second cross-sectional diameter different from said first cross-sectional diameter, concentrically positioned around said first tube and in which heating or cooling media flows; and c. a flow velocity adjustment system comprising:

i. a U-shaped portion of substantially constant third cross-sectional diameter greater than said first cross-sectional diameter and having first and second ends;

ii. a first flow reducer extending from said first end of said U-shaped body portion to a first of said first tubes, and tapering from said third cross-sectional diameter to said first cross-sectional diameter; and iii. a second flow reducer of eccentric cross-section, extending from said second end of said U-shaped body portion to a second of said first tubes, and tapering from said third cross-sectional diameter to said first cross-sectional diameter.

6. The heat exchange system of claim 5, wherein a clamping assembly interconnects said first flow reducer to a first of said first tubes.

7. The heat exchange system of claim 6, wherein said clamping assembly comprises a pair of opposed flanges and a bolt interconnecting said pair of opposed flanges.

8. The heat exchange system of claim 7, wherein said clamping assembly further comprises a sealing member disposed between said pair of opposed flanges.

* * * * *